US005208868A

United States Patent [19]

Sapiejewski

[11] Patent Number: 5,208,868

[45] Date of Patent: May 4, 1993

[54] HEADPHONE OVERPRESSURE AND CLICK REDUCING

[75] Inventor: Roman Sapiejewski, Boston, Mass.

[73] Assignee: Bose Corporation, Framingham, Mass.

[21] Appl. No.: 665,644

[22] Filed: Mar. 6, 1991

[51] Int. Cl.[5] ..... H04R 25/00

[52] U.S. Cl. ..... 381/183; 381/187; 381/74

[58] Field of Search ..... 381/25, 72, 74, 183, 381/187, 68.6; 181/129, 135; 73/585

[56] References Cited

U.S. PATENT DOCUMENTS

| | | | |
|---|---|---|---|
| 3,602,329 | 8/1971 | Bauer | 181/129 |
| 4,071,717 | 1/1978 | Fidi et al. | 381/187 |
| 4,133,984 | 1/1979 | Akiyama . | |
| 4,160,135 | 7/1979 | Görike | 381/187 |
| 4,455,675 | 6/1984 | Bose et al. | 381/74 |
| 4,644,581 | 2/1987 | Sapiejewski | 381/74 |
| 4,742,887 | 5/1988 | Yamagishi | 381/68 |
| 5,001,763 | 3/1991 | Moseley | 381/71 |
| 5,020,163 | 6/1991 | Aileo et al. | 381/183 |

*Primary Examiner*—Jin F. Ng
*Assistant Examiner*—Huyen D. Le
*Attorney, Agent, or Firm*—Fish & Richardson

[57] ABSTRACT

Apparatus for reducing pressure inside a headphone includes a port between front and back cavities. Preferably there is a resistive element and a high compliance diaphragm.

7 Claims, 2 Drawing Sheets

HEADPHONE OVERPRESSURE AND CLICK REDUCING

The present invention relates in general to headphones and more particularly concerns novel apparatus and techniques for overpressure and click reducing.

An around-the-ear noise-cancelling headphone is more effective with a tight seal to the head. The double ring silicone cushion described in Sapiejewski U.S. Pat. No. 4,856,118 entitled HEADPHONE CUSHIONING granted Aug. 15, 1989, is very effective is this respect.

A tight seal may result in a tendency of the system to create a very high pressure level ($\approx$/30 db) at very low frequencies (<10 Hz) inside the ear cup when the head moves. This high pressure may cause unpleasant effects, such as clicks. A very light and compliant diaphragm of the headphone driver may bottom to create an unwanted audible click.

The present invention is an apparatus for reducing pressure in a headphone comprising a headphone having a front and back cavity and a port inserted between the front and back cavities of the headphone tuned to about 50 Hz. The port may be a combination of a mass element and a resistive element. The mass element provides high impedance such that there is no deterioration of passive noise attenuation (back cavity is open to the outside below 90 Hz). The mass element may be made of a hexagonal section having a threaded inner surface and a threaded portion having the same diameter as the inner surface of the hexagonal section. The resistive element provides a first order roll-off for stability of the feedback loop. The resistive element may be a fine mesh wire screen.

The invention represents an improvement in the commercially available Bose Active Noise Reducing headphones embodying features in Bose et al. U.S. Pat. No. 4,455,675 for HEADPHONING granted Jun. 19, 1984, Sapiejewski U.S. Pat. No. 4,644,581 for HEADPHONE WITH SOUND PRESSURE SENSING MEANS granted Feb. 17, 1987, Sapiejewski et al. copending application Ser. No. 07/398,133 for HIGH COMPLIANCE HEADPHONE DRIVING filed Aug. 23, 1989, abandoned and continued in application Ser. No. 07/782,874, filed Oct. 16, 1991, now U.S. Pat. No. 5,181,252, granted Jan. 19, 1993. Sapiejewski copending application Ser. No. 07/427,767 for EARPHONING filed Oct. 27, 1989, all incorporated by reference herein.

Other features, object and advantages of the invention will become apparent from the following description when read in connection with the accompanying drawings in which.

Figure 1:
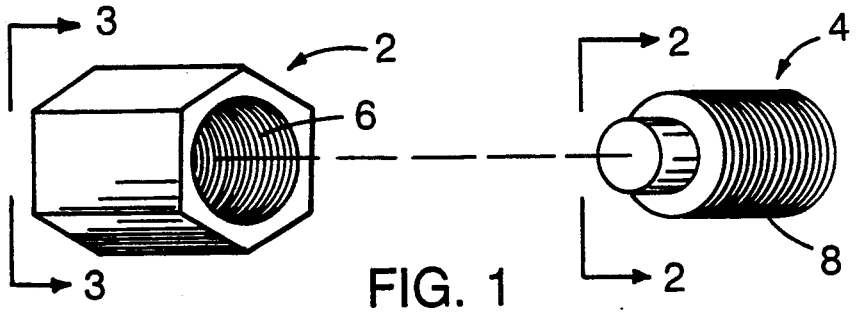
FIG. 1 is an exploded view of the mass element.

With reference now to the drawings and more particularly FIG. 1 thereof, there is shown an exemplary embodiment of the invention.

Figure 3:
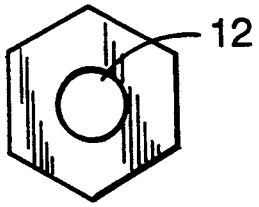
FIG. 3 is a cross-sectional view taken along line 3—3 in FIG. 1.
Figure 4:
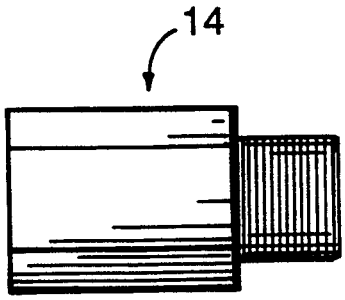
FIG. 4 is an exemplary mass element.

FIG. 1 shows hexagonal shaped element 2 and threaded element 4. The diameter of inner surface 6 of hexagonal shaped element 2 is the same as the outer diameter of threaded element 4. Inner surface 6 of hexagonal shaped element 2 is threaded such that threaded element 4 may be threaded into hexagonal shaped element 2. At about the midpoint of hexagonal shaped element 2, the inner surface 6 narrows such that the diameter 12 is the same as the inner diameter 10 of threaded element 4 (see FIGS. 2 and 3). This constriction prevents further threading of threaded portion 4 into hexagonal shaped element 2 such that the length of the mass element 14 is about 20 mm as shown in FIG. 4. The inner diameter 10 of threaded element 4 is about 3 mm.

The resistive element may be made of a fine mesh wire screen and inserted into the 3 mm diameter opening of mass element 14.

This element may be square mesh wire cloth with 150 mesh wires per linear inch and about 40% of the area being openings in the mesh. Other resistive materials may be used such as paper, rock wool, fiberglass, and other materials. The resistance may be introduced in other ways, such as lining the interior of the port and/or cavity.

Figure 5:
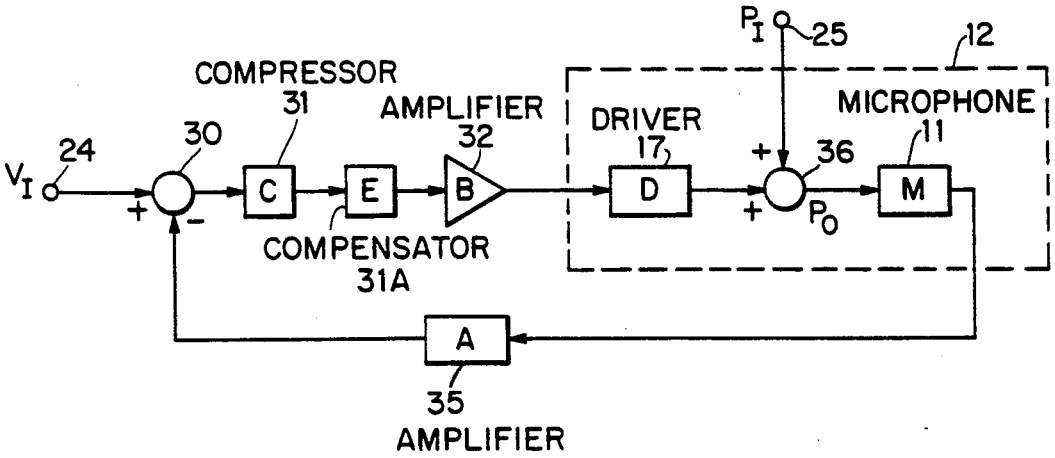
FIG. 5 is a block diagram illustrating the logical arrangement of a system embodying the invention.

Referring to FIG. 5, there is shown a block diagram illustrating the logical arrangement of an active noise reduction system embodying the invention corresponding substantially to FIG. 4 of the aforesaid copending application Ser. No. 07/398,133 for HIGH COMPLIANCE HEADPHONE DRIVING filed Aug. 23, 1989, the parent of application Ser. No. 07/782,874, filed Oct. 16, 1991, now U.S. Pat. No. 5,181,252 granted Jan. 19, 1993.

Figure 2:
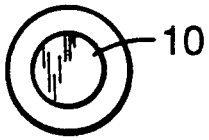
FIG. 2 is a cross-sectional view taken along line 2—2 in FIG. 1.
Figure 6:
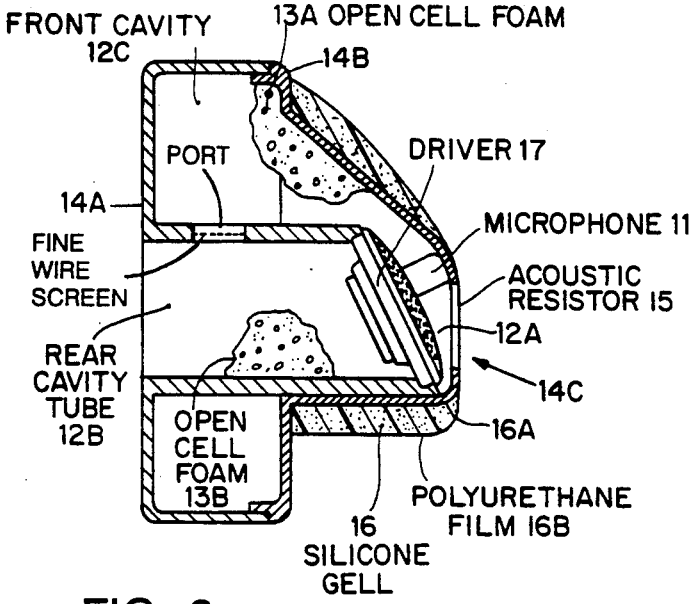
FIG. 6 is an axial sectional view of an embodiment of the invention.

Referring to FIG. 6, there is shown an axial sectional view of an embodiment of the invention corresponding substantially top FIG. 2 in the aforesaid copending application Ser. No. 07/427,767 for EARPHONING filed Oct. 27, 1989, having the port with a fine wire screen between front cavity 12C and rear cavity tube 12B.

Figure 7:
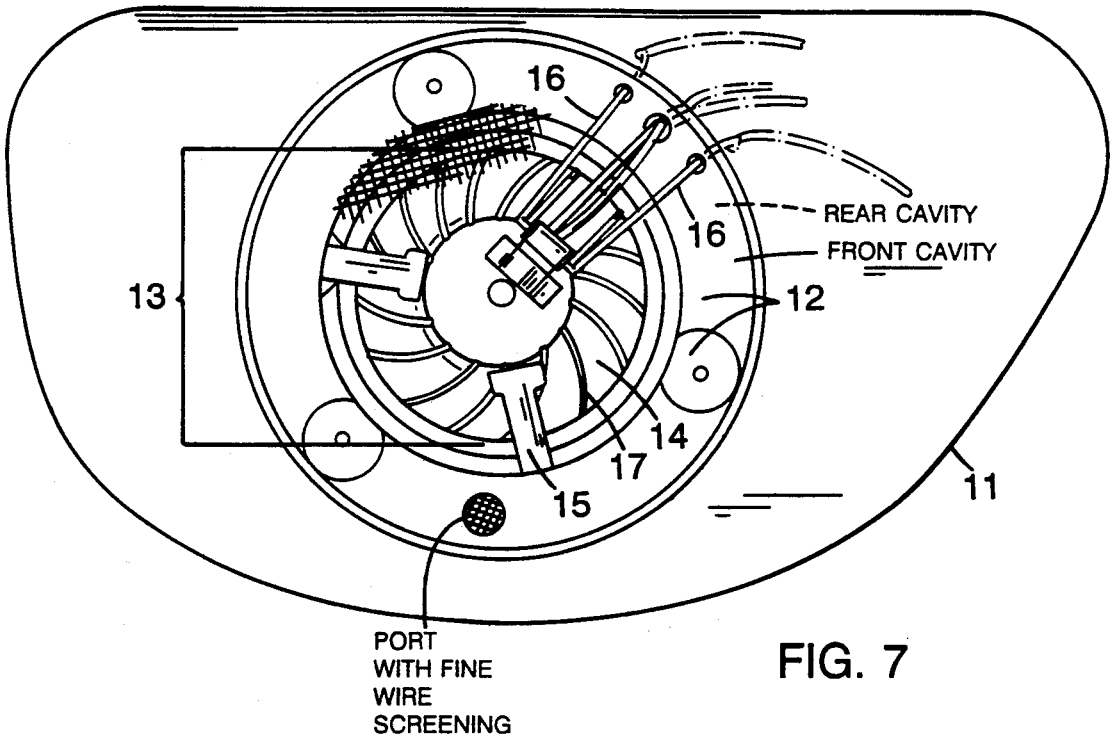
FIG. 7 is a plan view of another embodiment of the invention.

Referring to FIG. 7, there is shown a plan view of another embodiment of the invention corresponding substantially to FIG. 1 in the aforesaid U.S. Pat. No. 5,181,252 showing the port with fine wire screening between front and rear cavities.

Other embodiments are within the claims.

What is claimed is:

1. Apparatus for reducing pressure in a headphone comprising a headphone having a front and back cavity; and a port tuned to about 50 Hz inserted between the front and back cavities of the headphone, said port being a combination of a mass element and a resistive element with said resistive element in said port.

2. Apparatus according to claim 1 wherein said mass element provides high acoustic impedance to negligibly reduce passive noise attenuation.

3. The apparatus according to claim 1 wherein said resistive element comprises a fine mesh wire screen.

4. Apparatus for reducing pressure in a headphone comprising, a headphone having a front and back cavity; and a port inserted between the front and back cavities of the headphone, wherein said port is a combination of a mass element and a resistive element, wherein said mass element provides high acoustic impedance to negligibly reduce passive noise attenuation, wherein said mass element comprises a hexagonal section having a threaded inner surface; and a threaded portion having the same diameter as the inner surface of the hexagonal section.

5. Apparatus for reducing pressure in the headphone comprising, a headphone having a front and back cavity; and a port inserted between the front and back cavities of the headphone, wherein said port is a combination of a mass element and a resistive element, wherein said apparatus provides active noise reduction and includes a feedback loop with said resistive element providing a first order roll-off for stability of the feedback loop.

6. Apparatus for reducing pressure in a headphone comprising, a headphone having a front and back cavity;

and a port tuned to about 50 Hz inserted between the front and back cavities of the headphone, wherein said port is a combination of a mass element and a resistive element, wherein said mass element provides high acoustic impedance to negligibly reduce passive noise attenuation, wherein said mass element comprises a hexagonal section having a threaded inner surface; and a threaded portion having the same diameter as the inner surface of the hexagonal section.

7. Apparatus for reducing pressure in a headphone comprising, a headphone having a front and back cavity; and a port tuned to about 50 Hz inserted between the front and back cavities of the headphone, wherein said port is a combination of a mass element and a resistive element, wherein said apparatus provides active noise reduction and includes a feedback loop with said resistive element providing a first order roll-off for stability of the feedback loop.

* * * * *